US009141036B2

(12) United States Patent
Berg

(10) Patent No.: US 9,141,036 B2
(45) Date of Patent: Sep. 22, 2015

(54) DIGITAL PRINTER FOR PRINTING TO A RECORDING MEDIUM

(71) Applicant: Martin Berg, Poing (DE)

(72) Inventor: Martin Berg, Poing (DE)

(73) Assignee: Océ Printing Systems GmbH & CO. KG, Poing (DE)

( * ) Notice: Subject to any disclaimer, the term of this patent is extended or adjusted under 35 U.S.C. 154(b) by 0 days.

(21) Appl. No.: 14/162,791

(22) Filed: Jan. 24, 2014

(65) Prior Publication Data

US 2014/0212176 A1 Jul. 31, 2014

(30) Foreign Application Priority Data

Jan. 29, 2013 (DE) ..... 10 2013 100 843

(51) Int. Cl.
*G03G 15/10* (2006.01)
*G03G 15/08* (2006.01)

(52) U.S. Cl.
CPC ..... *G03G 15/104* (2013.01); *G03G 15/0812* (2013.01); *G03G 15/101* (2013.01)

(58) Field of Classification Search
CPC ..... G03G 15/10; G03G 15/11
USPC ..... 399/239, 249
See application file for complete search history.

(56) References Cited

U.S. PATENT DOCUMENTS

| | | | | |
|---|---|---|---|---|
| 4,239,371 | A * | 12/1980 | Igarashi et al. | 399/169 |
| 6,085,054 | A * | 7/2000 | Kusayanagi | 399/249 |
| 6,895,200 | B2 | 5/2005 | Tagansky | |
| 7,292,810 | B2 | 11/2007 | Tanner et al. | |
| 7,522,865 | B2 | 4/2009 | Hasdai et al. | |
| 8,509,656 | B2 | 8/2013 | Kopp | |
| 2002/0159794 | A1 | 10/2002 | Nakashima et al. | |
| 2009/0035022 | A1 | 2/2009 | Aruga et al. | |
| 2009/0196657 | A1 | 8/2009 | Okumura et al. | |

FOREIGN PATENT DOCUMENTS

| | | | |
|---|---|---|---|
| DE | 102008048256 | A1 | 4/2010 |
| DE | 102009060334 | A1 | 6/2011 |
| DE | 102010015985 | A1 | 9/2011 |
| WO | 2006090352 | A1 | 8/2006 |

* cited by examiner

*Primary Examiner* — Erika J Villaluna
(74) *Attorney, Agent, or Firm* — Schiff Hardin LLP

(57) ABSTRACT

A digital printer has at least one print group with a station to generate charge images of images to be printed on a charge image carrier, the station having a developer station to ink the charge images using liquid carrier having toner and carrier fluid. The developer station comprises a rotating application unit that transports the liquid developer to the charge image carrier. The feed system feeds the liquid developer to the application unit. The dosing unit adjacent to the application unit and after the feed system comprises a dosing roller and an elastic unit acting on the dosing roller, the elastic unit exerting an adjustable contact pressure force on the dosing roller in a direction of the application unit.

9 Claims, 4 Drawing Sheets

DIGITAL PRINTER FOR PRINTING TO A RECORDING MEDIUM

BACKGROUND

The disclosure concerns a digital printer for printing to a recording medium with toner particles that are applied with the aid of a liquid developer, in particular a high-speed printer for printing to web-shaped or sheet-shaped recording media.

In such digital printers, a latent charge image of a charge image carrier is inked by means of electrophoresis, with the aid of a liquid developer. The toner image that is created in such a manner is transferred indirectly (via a transfer element) or directly to the recording medium. The liquid developer has toner particles and carrier fluid in a desired ratio. Mineral oil is advantageously used as carrier fluid. In order to provide the toner particles with an electrostatic charge, charge carrier substances are added to the liquid developer. Further additives are additionally added, for example, in order to achieve the desired viscosity or a desired drying behavior of the liquid developer.

Such digital printers have long been known, for example, from DE 10 2010 015 985 A1, DE 10 2008 048 256 A1 or DE 10 2009 060 334 A1.

To ink the charge images on the charge image carrier, liquid developer is directed past the charge image carrier by a developer station. The developer station has in a known manner a developer roller that directs the liquid developer past the charge image carrier; an application system that supplies the liquid developer to the developer roller; and a cleaning unit that cleans off the residual liquid developer remaining on the developer roller after the inking of the charge images on the charge image carrier. The cleaning unit provides, for example, a cleaning roller that removes the residual liquid developer from the developer roller; an electric field thereby exists between developer roller and cleaning roller that promotes the transfer of the residual liquid developer, for example. The residual liquid developer can be scraped off the cleaning roller by a blade. No residual toner should thereby remain on the cleaning roller, since otherwise this could arrive at the developer roller again.

Developer stations in which liquid developer is supplied to a charge image carrier are known. In U.S. Pat. Nos. 7,522,865 B2, 7,292,810 B2, 6,895,200 B2, developer stations are described in which liquid developer is directed past a developer roller. Arranged adjacent to the developer roller is an electrode between which and the developer roller the liquid developer is directed. An electrical voltage via which the toner is attracted to the developer roller exists between the electrode and the developer roller. Before the liquid developer is supplied to the charge image carrier, it travels through a gap (nip) that exists between a dosing unit (a blade or a dosing roller) and the developer roller. The dosing unit is at such an electrical potential that the toner migrates towards the developer roller; the thickness of the liquid developer layer on the developer roller is simultaneously established. Examples of a dosing unit are described in WO 2006/090352 A1 and US 2002/0159794 A1.

SUMMARY

It is an object to achieve a digital printer for printing to a recording medium, which digital printer has a high process stability given minimized stressing of the liquid developer due to low mechanical stress, and that has a high print quality due to consistent properties of the liquid developer. In particular, a developer station should be specified in which liquid developer is transferred with a feed system onto an application unit, and the liquid developer on the application unit is dosed with a dosing unit so that the transfer of the liquid developer (in particular of the toner particles) onto the charge image carrier is optimized. A developer roller or a developer belt can be provided as an application unit.

A digital printer has at least one print group with a station to generate charge images of images to be printed on a charge image carrier, the station having a developer station to ink the charge images using liquid carrier having toner and carrier fluid. The developer station comprises a rotating application unit that transports the liquid developer to the charge image carrier. The feed system feeds the liquid developer to the application unit. The dosing unit adjacent to the application unit and after the feed system comprises a dosing roller and an elastic unit acting on the dosing roller, the elastic unit exerting an adjustable contact pressure force on the dosing roller in a direction of the application unit.

DESCRIPTION OF THE EXEMPLARY EMBODIMENTS

Figure 1:
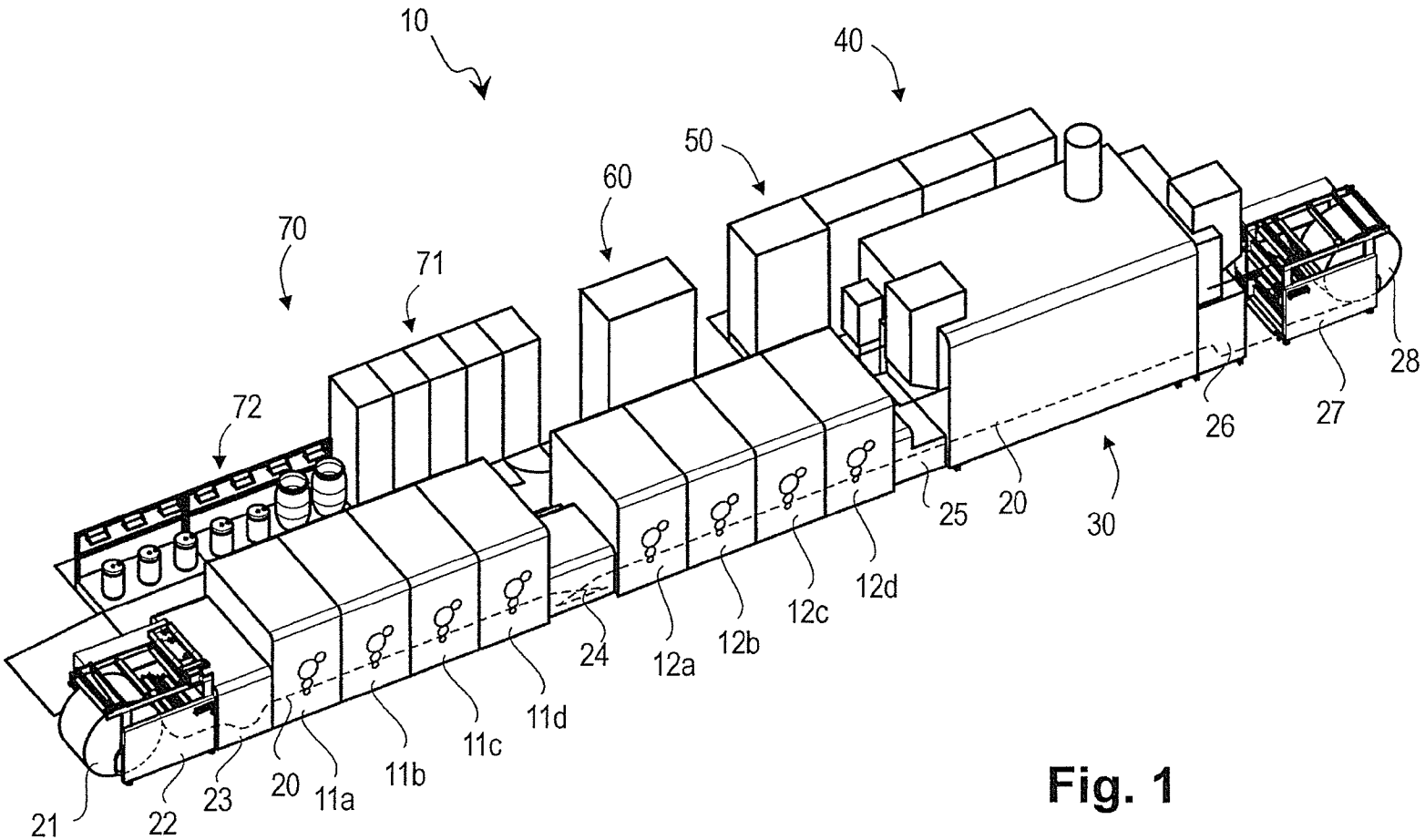
FIG. 1 is a view of a digital printer in an exemplary configuration of the digital printer.

For the purposes of promoting an understanding of the principles of the invention, reference will now be made to the preferred exemplary embodiments/best mode illustrated in the drawings and specific language will be used to describe the same. It will nevertheless be understood that no limitation of the scope of the invention is thereby intended, and such alterations and further modifications in the illustrated embodiments and such further applications of the principles of the invention as illustrated as would normally occur to one skilled in the art to which the invention relates are included herein.

The digital printer for printing to a recording medium has at least one print group with an electrophotography station to generate charge images of images to be printed on a charge image carrier, and with a developer station to ink the charge images on the charge image carrier using liquid developer.

For this, the developer station comprises:

- A rotating application unit via which the liquid developer is transported to the charge image carrier; the application unit can be a developer roller that transports the liquid developer to the charge image carrier.
- A feed system arranged adjacent to the application unit for the transport of liquid developer to the application unit, with a pre-chamber and an electrode segment, such that the application unit can accept liquid developer from the pre-chamber, and wherein the electrode segment is at such an electrical potential that toner of the liquid developer passes to the application unit.
- A dosing unit that rests with an adjustable degree of elasticity on the application unit, such that the amount of liquid developer conveyed to the charge image carrier can be adapted to the respective requirements of the digital printer.

A dosing roller borne such that it can rotate on a level arm can be provided as a dosing unit, wherein a spring unit engages at the lever arm such that it exerts an elastic force in the direction of the developer roller. At least one spring whose elastic force is adjustable can be provided as an elastic unit. It is advantageous if two pressure springs are used as an elastic unit that engages at the lever arm (and therefore at the dosing roller) with differently adjustable contact pressure force. The elastic unit can also have a tension spring that exerts a tensile force on the lever arm (and therefore on the dosing roller). The elastic force of a pressure spring can therefore be reduced.

In a further exemplary embodiment, the elastic unit can have at least one pressure spring with adjustable elastic force and a controllable adjustment mechanism that has an actuator that can be hydraulically or pneumatically actuated in order to execute a force on the lever (and therefore on the dosing roller) that can controllably reinforce the elastic force of the pressure spring or counteract this.

The nip between the dosing roller and the developer roller can be varied with the elastic unit according to the exemplary embodiment so that the amount of liquid developer conveyed to the charge image carrier can be adapted to the respective use case of the digital printer.

Without this adaptation, the conveyed amount would be increased with increasing print speed, wherein the proportion of carrier fluid would be increased given a sought constant inking (and therefore the same conveyed amount of toner). The conveyed amount can be kept constant over a large speed range by changing the thickness of the liquid developer layer.

Furthermore, the amount of carrier fluid can be adapted to the readout module, for example can be increased.

The adaptation of the conveyed amount to the use case can take place by overlaying a factory setting on an adjustment in the print operation by changing the contact pressure force of the elastic unit.

The amount of carrier fluid and toner can therefore also be adjusted in the print operation, and therefore a constant print quality can be achieved in ramp printing, for example.

According to FIG. 1, a digital printer 10 for printing to a recording medium 20 has one or more print groups 11*a*-11*d* and 12*a*-12*d* that print a toner image (print image 20'; see FIG. 2) onto the recording medium 20. As shown, a web-shaped recording medium 20 as recording medium 20 is unwound from a roll 21 with the aid of an unroller 22 and supplied to the first print group 11*a*. The print image 20' is fixed on the recording medium 20 in a fixing unit 30. The recording medium 20 can subsequently be rolled up on a roll 28 with the aid of a take-up roller 27. Such a configuration is also designated as a roll-to-roll printer.

In the preferred configuration shown in FIG. 1, the web-shaped recording medium 20 is printed in full color on the front side with four print groups 11*a* through 11*d* and on the back side with four print groups 12*a* through 12*d*. For this, the recording medium 30 is unrolled from the roll 21 by the unroller 22 and is supplied via an optional conditioning group 23 to the first print group 11*a*. In the conditioning group 23, the recording medium 20 can be pretreated or coated with a suitable substance. Wax or chemically equivalent substances can advantageously be used as a coating substance (also designated as a primer).

This substance can be applied over the entire area, or only to the locations of the recording medium 20 that are to be printed later, in order to prepare the recording medium 20 for the printing and/or to affect the absorption behavior of the recording medium 20 upon the apparatus of the print image 20'. It is therefore prevented that the toner particles or the carrier fluid that are applied later do not penetrate too much into the recording medium 20 but rather remain significantly on the surface (color and image quality is thereby improved).

The recording medium 20 is subsequently initially supplied in order to the first print groups 11*a* through 11*d* in which only the front side is printed. Each print group 11*a*-11*d* typically prints to the recording medium 20 in a different color or also with a different toner material (for example MICR toner, which can be read electromagnetically).

After printing to the front side, the recording medium 20 is turned in a turning unit 24 and supplied to the remaining print groups 12*a*-12*d* for printing to the back side. Optionally, an additional conditioning group (not shown) can be arranged in the region of the turning unit 24, via which the recording medium 20 is prepared for printing to the back side—for example a fixing (partial fixing) or other conditioning of the previously printed front side print image (or of the entire front side or even back side). It is thus prevented that the front side print image is mechanically damaged in the further transport through the subsequent print groups.

In order to achieve a full color printing, at least four colors (and therefore at least four print groups 11, 12) are required, and in fact the primary colors YMCK (yellow, magenta, cyan and black), for example. Additional print groups 11, 12 with special colors (for example customer-specific colors or additional primary colors in order to expand the printable color space) can also be used.

Arranged after the print group 12*d* is a register unit 25 via which registration marks that are printed on the recording medium 20 independent of the print image 20' (in particular outside of the print image 20') are evaluated. The transverse and longitudinal registration (the primary color points that form a color point should be arranged atop one another or spatially very close to one another; this is also designated as color register or four-color register) and the register (front side and back side must spatially coincide precisely) can therefore be adjusted so that a qualitatively good print image 20' is achieved.

Arranged after the register unit 25 is the fixer unit 30 via which the print image 20' is fixed on the recording medium 20. In electrophoretic digital printing, a thermal dryer is advantageously used as a fixer unit 30, which thermal dryer for the most part evaporates the carrier fluid so that only the toner particles remain on the recording medium 20. This occurs under the effect of heat. The toner particles can thereby also be fused to the recording medium 20 insofar as they have a material (resin, for example) that can be melted as a result of thermal action.

Arranged after the fixer unit 30 is a feed group 26 that draws the recording medium 20 through all print groups 11*a*-12*d* and the fixing unit 30 without an additional drive being arranged in this region. The danger that the not-yet fixed print image 20' could be smeared would exist due to a friction drive for the recording medium 20.

The feed group 26 supplies the recording medium 20 to the take-up roller 27 that rolls up the printed recording medium 20.

Centrally arranged in the print groups 11, 12 and the fixer unit 30 are all supply devices for the digital printer 10, such as climate control modules 40, power supply 50, controller 60, fluid management modules 70 (such as fluid control unit 71 and reservoir 72 of the various fluids). Hereby required as fluids are in particular pure carrier fluid, highly concentrated liquid developer (higher proportion of toner particles in relation to the carrier fluid) and serum (liquid developer plus charge control substances) in order to supply the digital printer 10, as well as waste containers for the fluids to be disposed of or containers for cleaning fluid.

The digital printer 10 has a modular design with its structurally identical print groups 11, 12. The print groups 11, 12 do not differ mechanically but rather via the liquid developer (toner color or toner type) that is used therein.

Figure 2:
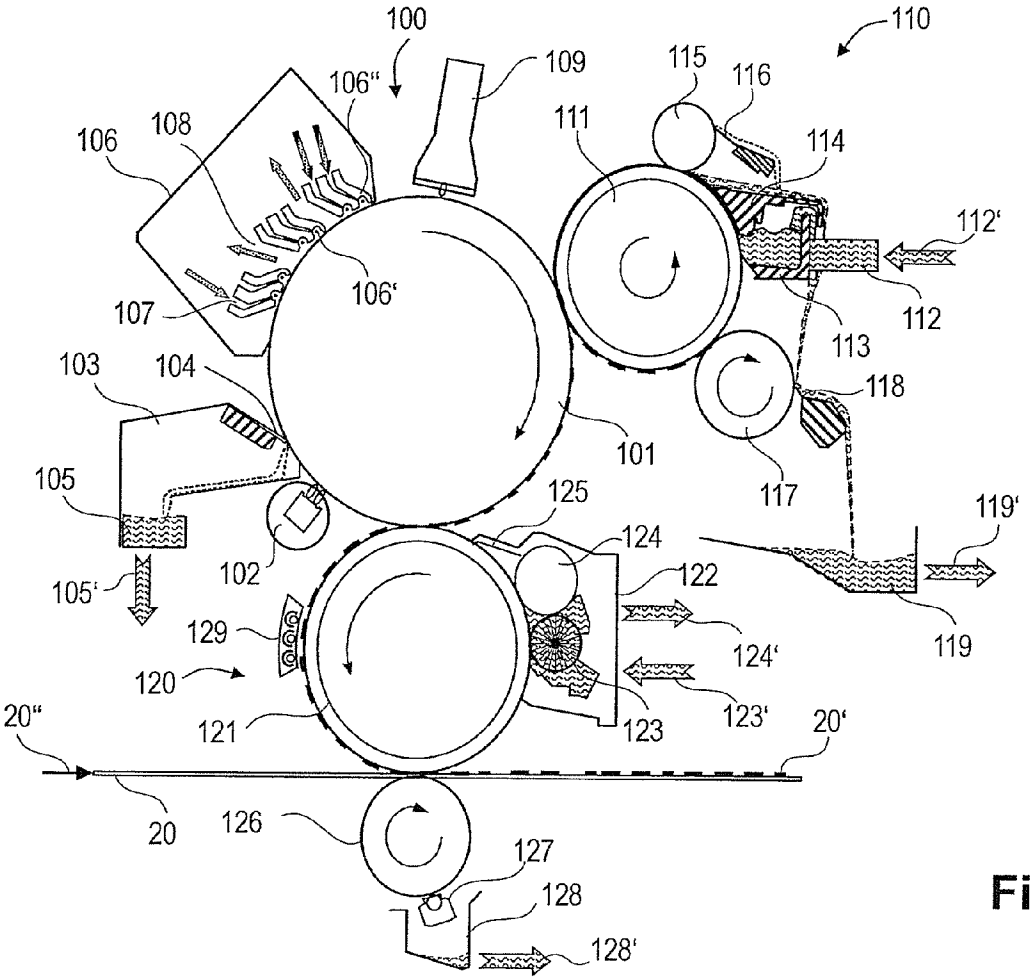
FIG. 2 is a schematic design of a print group of the digital printer according to FIG. 1.

The principle design of a print group 11, 12 is shown in FIG. 2. Such a print group is based on the electrophotographic principle, in which a photoelectric image carrier is inked with charged toner particles with the aid of a liquid developer, and the image that is created in such a way is transferred to the recording medium 20.

The print group 11, 12 essentially comprises an electrophotography station 100, a developer station 110 and a transfer station 120.

The core of the electrophotography station 100 is a photoelectric image carrier that has on its surface a photoelectric layer (what is known as a photoconductor). The photoconductor here is designed as a roller (photoconductor roller 101) and has a hard surface. The photoconductor roller 101 rotates past the various elements to generate a print image 20' (rotation in direction of the arrow).

The photoconductor is initially cleaned of all contaminants. For this, a canceling light 102 is present that cancels charges still remaining on the surface of the photoconductor. The canceling light 102 is adjustable (can be set locally) in order to achieve a homogeneous light distribution. The surface can therefore be pretreated uniformly.

After the canceling light 102, a cleaning device 103 mechanically cleans the photoconductor in order to remove possible dust particles present on the surface of the photoconductor and remaining carrier fluid. The cleaned-off carrier fluid is supplied to a collection container 105. The collected carrier fluid and toner particles are prepared (possibly filtered) and, depending on the color, supplied to a corresponding fluid ink reservoir, i.e. to one of the reservoirs 72 (see arrow 105').

The cleaning device 103 advantageously has a blade 104 that rests on the shell of the photoconductor roller 101 at an acute angle (for instance 10° to 80° relative to the exit surface) in order to mechanically clean the surface. The blade 104 can move back and forth transverse to the rotation direction of the photoconductor roller 101 in order to clean the shell over the entire axial length with as little wear as possible.

The photoconductor is subsequently charged by a charging device 106 to a predetermined electrostatic potential. Multiple corotrons (in particular glass sheath corotrons) are advantageously present for this. The corotrons comprise at least one wire 106' at which a high electric voltage is applied. The air around the wire 106' is ionized by the voltage. A shield 106" is present as a counter-electrode. The corotrons are additionally flushed with fresh air that is supplied via special air channels (ventilation channel 107 for aeration and exhaust channel 108 for venting) between the shields (see also air flow arrows in FIG. 2). The supplied air is then ionized uniformly at the wire 106'. A homogeneous, uniform charging of the adjacent surface of the photoconductor is thereby achieved. The uniform charging is further improved with dry and heated air. Air is exhausted via the exhaust channels 108. Ozone that is possibly created can likewise be drawn off via the exhaust channels 108.

The corotrons can be cascaded, meaning that two or more wires 106' are then present per shield 106" at the same shield voltage. The current that flows over the shield 106" is adjustable, and the charge of the photoconductor can thereby be controlled. The corotrons can be fed with current of different strengths in order to achieve a uniform and sufficiently high charge at the photoconductor.

Arranged after the charging device 106 is a character generator 109 that discharges the photoconductor per pixel depending on the desired print image 20' via optical radiation. A latent image thereby arises that is later inked with toner particles (the inked image corresponds to the print image 20'). An LED character generator 109 is advantageously used in which an LED line with many individual LEDs is arranged stationary over the entire axial length of the photoconductor roller 101. Among other things, the number of LEDs and the size of the optical imaging points on the photoconductor determine the resolution of the print image 20' (typical resolution is 600×600 dpi). The LEDs can be controlled individually in time and with regard to their radiation power. Multilevel methods can thus be applied to generate raster points (comprising multiple image points or pixels) or image points can be delayed in order to implement corrections electro-optically, for example given an incorrect color register or register.

The character generator 109 has a control logic that must be cooled due to the plurality of LEDs and their radiation power. The character generator 109 is advantageously liquid-cooled. The LEDs can be controlled in groups (multiple LEDs assembled into one group) or separately from one another.

The latent image generated by the character generator 109 is inked with toner particles by the developer station 110. For this the developer station 110 has a rotating application unit comprising a developer roller 111 that directs a layer of liquid developer past the photoconductor (the functionality of the developer station 110 is explained in detail further below). Since the surface of the photoconductor roller 101 is relatively hard, the surface of the developer roller 111 is relatively soft, and when the two are pressed against one another a thin, high nip (a gap between the rollers) is created in which the charged toner particles migrate electrophoretically from the developer roller 111 to the photoconductor at the image points due to an electric field. No toner passes to the photoconductor in the non-image points. The nip filled with liquid developer has a height (thickness of the gap) that is dependent on the mutual pressure of the two rollers 101, 111 and the viscosity of the liquid developer. The thickness of the nip is typically in a range of (for instance) greater than 2 μm to (for instance) 20 μm (the values can also change depending on the viscosity of the liquid developer). The length of the nip amounts to a few millimeters, for instance.

The inked image rotates with the photoconductor roller 101 up to a first transfer point at which the inked image is essentially completely transferred to a transfer roller 121. At the first transfer point (nip between photoconductor roller 101 and transfer roller 121), the transfer roller 121 moves in the same direction and advantageously with the same speed as the photoconductor roller 101. After the transfer of the print image 20' onto the transfer roller 121, the print image 20' (toner particles) can optionally be recharged or charged by means of a charging unit 129 (a corotron, for example) in order to be able to subsequently transfer the toner particles better onto the recording medium 20.

The recording medium 20 runs in the transport direction 20" between the transfer roller 121 and a counter-pressure roller 126. The contact region (nip) represents a second transfer point in which the toner image is transferred onto the recording medium 20. In the second transfer region, the transfer roller 121 moves in the same direction as the recording medium 20. The counter-pressure roller 126 also rotates in this direction in the region of the nip. The speeds of the transfer roller 121, the counter-pressure roller 126 and the recording medium 20 are matched to one another at the transfer point and are advantageously identical so that the print image 20' is not smeared. At the second transfer point, the print image 20' is electrophoretically transferred onto the recording medium 20 due to an electric field between the transfer roller 121 and the counter-pressure roller 126. Moreover, the counter-pressure roller 126 presses with a large mechanical force against the relatively soft transfer roller 121, whereby the toner particles also remain adhered to the recording medium 20 due to the adhesion.

Since the surface of the transfer roller 121 is relatively soft and the surface of the counter-pressure roller 126 is relatively hard, upon rolling a nip is created in which the toner transfer occurs. Unevennesses of the recording medium 20 can therefore be compensated so that the recording medium 20 can be printed to without gaps. Such a nip is also well suited in order to print to thicker or more uneven recording media 20, for example as is the case in printing packaging.

The print image 20' should in fact transfer completely to the recording medium 20; nevertheless, a few toner particles can undesirably remain on the transfer roller 121. A portion of the carrier fluid always remains on the transfer roller 121 as a result of the wetting. The toner particles that are possibly still present should be nearly completely removed via a cleaning unit 122 following the second transfer point. The carrier fluid located on the transfer roller 121 can also be removed completely or up to a predetermined layer thickness from the transfer roller 121 so that, after the cleaning unit 122 and before the first transfer point from the photoconductor roller 101 to the transfer roller 121, the same conditions prevail due to a clean surface or a defined layer thickness with liquid developer on the surface of the transfer roller 121.

This cleaning unit 122 is advantageously designed as a wet chamber with a cleaning brush 123 and a cleaning roller 124. In the region of the brush 123, cleaning fluid (carrier fluid or a separate cleaning fluid can be used, for example) is supplied via a cleaning fluid feed 123'. The cleaning brush 123 rotates in the cleaning fluid and thereby "brushes" the surface of the transfer roller 121. The toner adhering to the surface is thereby loosened.

The cleaning roller 124 lies at an electric potential that is opposite the charge of the toner particles. As a result of this, the electrically charged toner is removed from the transfer roller 121 by the cleaning roller 123. Since the cleaning roller 124 contacts the transfer roller 121, it also takes up carrier fluid remaining on the transfer roller 121 together with the supplied cleaning fluid. A conditioning element 125 is arranged at the discharge from the wet chamber. As shown, a retention plate that is arranged at an obtuse angle (for instance between 100° and 170° between plate and discharge surface) relative to the transfer roller 121 can be used as a conditioning element 125, whereby residues of fluid on the surface of the roller are nearly completely retained in the wet chamber and are supplied to the cleaning roller 124 for removal via a cleaning fluid discharge 124' to a cleaning fluid reservoir (in the reservoirs 72) (not shown).

Instead of the retention plate, a dosing unit (not shown) can also be arranged there that, for example, has one or more dosing rollers. The dosing rollers have a predetermined clearance from the transfer roller 121 and remove so much carrier fluid that a predetermined layer thickness is set after the dosing rollers as a result of the squeezing. The surface of the transfer roller 121 is then not completely cleaned off; carrier fluid of a predetermined layer thickness remains over the entire surface. Removed carrier fluid is directed back to the carrier fluid reservoir via the cleaning roller 124.

The cleaning roller 124 itself is kept clean mechanically via a blade (not shown). Cleaned-off fluid including toner particles for all colors are captured via a central collection container, cleaned and supplied to the central cleaning fluid container for re-use.

The counter-pressure roller 126 is likewise cleaned by a cleaning unit 127. As a cleaning unit 127, a blade, a brush and/or a roller can remove contaminants (paper dust, toner particle residues, liquid developer etc.) from the counter-pressure roller 126. The cleaned fluid is collected in a collection container 128 and (possibly cleaned via a fluid discharge 128') provided again to the printing process.

In the print groups 11 that print to the front side of the recording medium 20, the counter-pressure roller 126 presses against the unprinted side (and thus undried side) of the recording medium 20.

Nevertheless, dust/paper particles or other soil particles can already be located on the dry side, which are then removed from the counter-pressure roller 126. For this, the counter-pressure roller 126 should be wider than the recording medium 20. As a result of this, contaminants outside of the printing region can also be cleaned off well.

In the print groups 12 that print to the back side of the recording medium 20, the counter-pressure roller 126 presses directly on the not yet fixed, damp print image 20' of the front side. So that the print image 20' is not removed by the counter-pressure roller 126, the surface of the counter-pressure roller 126 must have anti-adhesion properties with regard to toner particles, and also with regard to the carrier fluid on the recording medium 20.

The application unit comprising the rotating developer station 110 inks the latent print image 20' with a predetermined toner. For this, the application unit comprising the rotating developer roller 111 directs toner particles onto the photoconductor. In order to ink the developer roller 111 itself with a layer over its entire surface, liquid developer is initially supplied with a predetermined concentration from a mixing container (within the fluid control unit 71; not shown) via a fluid feed 112' to a storage chamber 112. From this storage chamber 112, the liquid developer is abundantly supplied to a pre-chamber 113 (a type of trough, open at the top). Towards the developer roller 111, an electrode segment 114 is arranged that forms a gap between itself and the developer roller 111.

The developer roller 111 rotates through the upwardly open pre-chamber 113 and thereby takes liquid developer along into the gap. Excess liquid developer runs from the pre-chamber 113 back to the storage chamber 112.

Due to the electrical field formed by the electrical potentials between the electrode segment 114 and the developer roller 111, the liquid developer is divided in the gap into two regions, and in fact into a layer region in proximity to the developer roller 111 in which the toner particles are concentrated (concentrated liquid developer) and a second region in proximity to the electrode segment 114 that is low in toner particles (very low-concentration liquid developer).

The layer of liquid developer is subsequently transported further to a dosing roller 115. The dosing roller 115 squeezes out the upper layer of the liquid developer so that a defined layer thickness of liquid developer of approximately 5 μm thickness subsequently remains on the developer roller 111. Since the toner particles are essentially located near the surface of the developer roller 111 in the carrier fluid, the outlying carrier fluid is essentially squeezed out or held back and is ultimately directed back to a collection container 119, but not supplied to the storage chamber 112.

As a result of this, predominantly highly concentrated liquid developer is conveyed through the nip between dosing roller 115 and developer roller 111. A uniformly thick layer of liquid developer thus arises with approximately 40 percent by mass toner particles and approximately 60 percent by mass carrier fluid after the dosing roller 115 (the mass ratios can also fluctuate more or less depending on the printing process requirements). This uniform layer of liquid developer is transported in a nip between the developer roller 111 and the photoconductor roller 101. There the image points of the latent image are then electrophoretically inked with toner particles, while no toner passes to the photoconductor in the region of non-image points. Sufficient carrier fluid for electrophoresis is absolutely necessary. The fluid film divides approximately in the middle after the nip as a result of wetting, such that one portion of the layer remains adhered to the surface of the photoconductor roller 101 and the other portion (essentially carrier fluid for image points and toner particles and carrier fluid for non-image points) remains on the developer roller 111.

So that the developer roller 111 can again be coated with liquid developer under the same conditions and uniformly, remaining toner particles (these essentially represent the negative, untransferred print image) and liquid developer are removed electrostatically and mechanically by a cleaning roller 117. The cleaning roller 117 itself is cleaned by a blade 118. The cleaned-off liquid developer is supplied to the collection container 119 for re-use, to which is also supplied liquid developer cleaned off from the dosing roller 115 by means of a blade 116 and liquid developer cleaned off of the photoconductor roller 101 by means of the blade 104.

The liquid developer collected in the collection container 119 is supplied to the mixing container via the fluid discharge 119'. Fresh liquid developer and pure carrier fluid are also supplied as needed to the mixing container. Sufficient fluid in the desired concentration (predetermined ratio of toner particles to carrier fluid) must always be present in the mixing container. The concentration in the mixing container is continuously measured and regulated accordingly depending on the feed of the amount of cleaned-off liquid developer and its concentration, as well as on the amount and concentration of fresh liquid developer or carrier fluid.

For this, highly concentrated liquid developer, pure carrier fluid, serum (carrier fluid and charge control substances in order to control the charge of the toner particles) and cleaned-off liquid developer can be separately supplied from the corresponding storage containers 72 to this mixing container.

The developer station 110 according to FIG. 2 thus comprises:

- A rotating application unit 111 that transports liquid developer directly to the photoconductor roller 101. The application unit 111 can comprise the developer roller 111 that transports liquid developer to the photoconductor roller 101.
- A feed system 113, 114 that supplies liquid developer to the application unit 111.
- A dosing unit 115, 116 that, for example, can be executed as a dosing roller 115 (possibly with the blade 116) and that conditions the layer of liquid developer supplied to the photoconductor roller 101.
- A cleaning unit 117, 118 with the cleaning roller 117 and with the cleaning blade 118. The cleaning roller 117 is arranged in contact with the developer roller 111 and removes residual liquid developer remaining on the developer roller 111 after the development of the charge images from said developer roller 111; this residual liquid developer is then scraped off of the cleaning roller 117 by the cleaning blade 118.

Respective electrical potentials are applied to the function elements (such as photoconductor roller 101, developer roller 111, feed system 114, cleaning roller 117, dosing roller 115), which electrical potentials change with the polarity of the toner charge (which can be positive or negative).

The basic function of the developer station 110 has already been explained above; this is referenced. The design of a dosing unit 130 (which comprises the dosing roller 115) is described further in the following. For this the most important functions of the developer station according to FIG. 2 are summarized again in the following:

The liquid developer is directed via the feed system 113, 114 to the developer roller 111, wherein the amount of liquid developer and the amount of toner included therein is greater than is required for the inking of the charge images on the photoconductor roller 101. The dosing of the toner quantity transferred to the developer roller 111 takes place via the difference potential between the electrode segment 114 and the developer roller 111. The liquid developer is thereby initially supplied in a lower toner concentration (5%-20%) to the pre-chamber 113. The toner concentration can be modified to 15% to 50% of the liquid developer at the roller surface of the developer roller 111 via the applied electrical field in the gap between developer roller 111 and the electrode segment 114; a high degree of inking of the charge images on the photoconductor roller 101 can thereby be achieved with a high electrical field strength and a low degree of inking can be achieved with a low electrical field strength.

Figure 3:
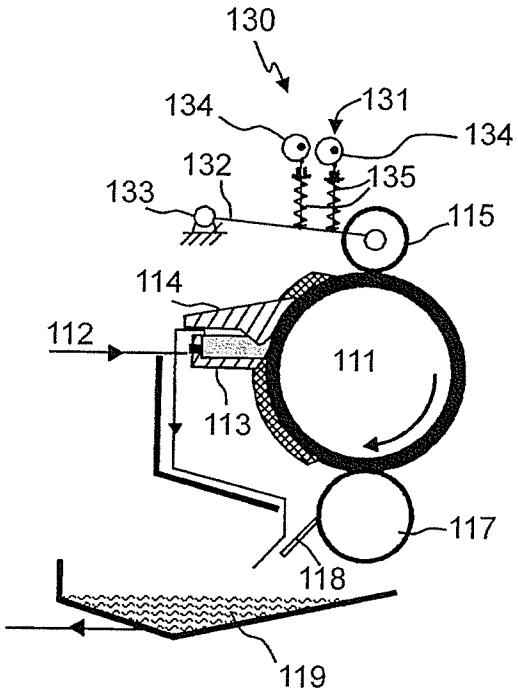
FIG. 3 is an embodiment of a developer station with a first dosing unit with which the amount of liquid developer conveyed to the charge image carrier can be adjusted.

The ultimate dosing of the liquid developer quantity before the feed to the photoconductor roller 101 can then take place with a dosing unit 130 shown in FIG. 3 with the dosing roller 115 with which the nip of the developer roller 111 is established. Contact pressure, hardness of the developer roller 111 or of the dosing roller 115, and roughness thereby determine the conveyed amount of liquid developer through the nip between the developer roller 111 and the dosing roller 115, and therefore the layer thickness of the liquid developer that arrives at the photoconductor roller 101. This conveyed quantity can furthermore be affected by a dosing unit 130 realized corresponding to FIG. 3 and FIG. 4, in which an adjustable elastic force can be exerted on the dosing roller. The dosing roller 115 thereby always has a higher potential than the developer roller 111. It is therefore ensured that no toner is undesirably transferred onto the dosing roller 115. The toner concentration in the liquid developer is simultaneously further increased, for example to 20% to 60% of the liquid developer, and ensures a uniform toner distribution on the developer roller 111.

Figure 4:
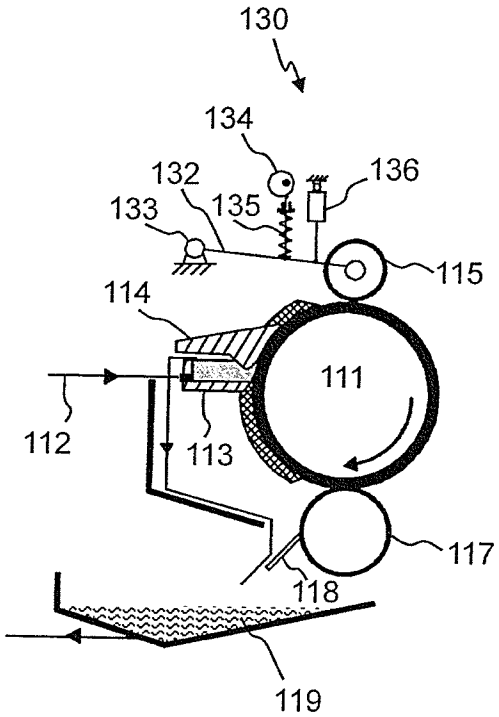
FIG. 4 is an embodiment of a developer station with a second dosing unit with which the amount of liquid developer conveyed to the charge image carrier can be adjusted.

FIGS. 3 and 4 show advantageous embodiments of the dosing unit 130 in principle. The dosing unit 130 has the dosing roller 115, which now rests on the developer roller 111 under an adjustable force of a spring unit 131. The dosing roller 115 is thereby arranged so as to be able to rotate at one end of a lever arm 132, which lever arm 132 is borne so as to be rotatable at another end at a bearing point 133. The spring unit 131 then engages at the lever arm 132 in order to be able to exert an adjustable force on the lever arm 132, and therefore on the dosing roller 115.

A first exemplary embodiment of a spring unit 131 is presented in FIG. 3. Here the spring unit 131 has two respective springs 135 (for example pressure springs) borne on an eccentric roller 134 that are attached to the lever arm 132. The springs 135 can exert a different force in the direction of the lever arm 132, and therefore on the dosing roller 115. This contact pressure force of the springs 135 on the lever arm 132 can additionally be changed in that the respective eccentric rollers 134 are rotated. In the application case, a spring 135 or both springs 135 can be operated and the contact pressure force on the dosing roller 115 can therefore be modified in stages. The spring 135 can thereby also exert a tensile force on the lever arm 132 given a corresponding position of the eccentric roller 134, whereby the contact pressure force of the one spring 135 would be reduced. According to FIG. 3, the elastic unit 131 can be operated given two springs 135 such that their forces acting on the lever arm 132 add up, or such that the contact pressure force of the one spring 135 on the lever arm 132 is counteracted by the other spring 135. The layer thickness of the liquid developer that is established by the dosing roller 115 can therefore be adapted in stages to different application cases.

In the exemplary embodiment of FIG. 4, a spring 135 is replaced by a controllable adjustment mechanism 136. The adjustment mechanism 136 can be realized as a pneumatic or hydraulic actuator that can be regulated. The adjustment mechanism 136 can thereby exert a pulling or pushing force on the lever arm 132 so that the force transferred to the dosing roller 115 is continuously adjustable, and therefore the nip formation between dosing roller 115 and developer roller 111 is as well. It is thus possible to set the optimal amount of liquid developer (or its concentration of toner) supplied to the charge image carrier for different application cases of the print groups 11, 12 of the digital printer 10, even given a starting process or braking process in which printing should take place.

In the exemplary embodiments of FIGS. 3 and 4, the elastic units 131 is shown only in principle in order to be able to explain their functions. The realization of these elastic unit 131 lies within the scope of the capabilities of the man skilled in the art. The number of springs 135 can thereby be adapted to the use case, such that one spring 135 or more than two springs can be provided.

After the conditioning of the liquid developer, this arrives in the contact zone between the developer roller 111 and the photoconductor roller 101; there the charge images are inked in a known manner. The electrical potentials at the developer roller 111 and the photoconductor roller 101 are selected so that toner is transferred onto the photoconductor 101 in the image locations and no toner is transferred onto the photoconductor roller 101 in the non-image locations.

The liquid developer remaining on the developer roller 111 after the development of the print image is subsequently removed from the developer roller 111 by the cleaning roller 117. For this, an electrical field exists between the developer roller 111 and the cleaning roller 117 such that the toner is drawn to the cleaning roller 117. The cleaning blade 118, which removes the remaining liquid developer from the cleaning roller 117, rests on the cleaning roller 117.

The photoconductor can preferably be designed in the form of a roller or a continuous belt. An amorphous silicon as a photoconductor or an organic photoconductor material (also designated as an OPC) can thereby be used.

Instead of a photoconductor, other image carriers (such as magnetic, ionizable etc. image carriers) can also be used that do not operate according to the photoelectric principle, but rather on which latent images are impressed electrically, magnetically or otherwise according to other principles, which latent images are then inked and ultimately are transferred onto the recording medium 20.

LED lines or even lasers with corresponding scan mechanism can be used as a character generator 109.

The transfer element can likewise be designed as a roller or as a continuous belt. The transfer element can also be omitted. The print image 20' is then transferred directly from the photoconductor roller 101 onto the recording medium 20.

What is to be understood by the term "electrophoresis" is the migration of charged toner particles in the carrier fluid as a result of the action of an electrical field. In each transfer of toner particles, the corresponding toner particles transfer essentially completely to another element. After contact of the two elements, the fluid film is split approximately in half as the result of the wetting of the participating elements so that approximately one half remains adhered to the first element and the remaining part remains adhered to the other element. The print image 20' is transferred, and in the next part it is then transported further in order to allow an electrophoretic migration of the toner particles again in the next transfer region.

The digital printer 10 can have one or more print groups for the front-side printing and possibly one or more print groups for the back-side printing. The print groups can be arranged in a line, an L-shape or a U-shape.

Instead of the take-up roller 27, post-processing devices (not shown)—such as cutters, folders, stackers etc.—can also be arranged after the feed group 26 in order to bring the recording medium 20 into the final form. For example, the recording medium 20 could be processed so much that a finished book is created at the end. The post-processing devices can likewise be arranged in a row or offset from this.

As has previously been described as a preferred embodiment, the digital printer 10 can be operated as a roll-to-roll printer. It is also possible to cut the recording medium 20 at the end into sheets and to stack the sheets or process them further in a suitable manner (roll-to-sheet printer). It is likewise possible to supply a sheet-shaped recording medium 20 to the digital printer 10 and to stack or further process the sheets at the end (sheet-to-sheet printer).

If only the front side of the recording medium 20 is printed, at least one print group 11 with a color is required (simplex printing). If the back side is also printed, at least one print group 12 for the back side is furthermore required (duplex printing). Depending on the desired print image 20' on the front side and back side, the printer configuration includes a corresponding number of print groups for front side and back side, wherein each print group 11, 12 is always designed for only one color or one type of toner.

The maximum number of print groups 11, 12 is technically dependent on the maximum mechanical tensile load of the recording medium 20 and the free train length. Arbitrary configurations from a 1/0 configuration (only one print group for the front side to be printed) to a 6/6 configuration (in which six print groups are respectively present for front side and back side of the recording medium 20) can typically be present. The preferred embodiment (configuration) is shown in FIG. 1 (a 4/4 configuration) with which the full color printing for front side and back side is provided with four primary colors. The order of the print groups 11, 12 in a four color printing advantageously goes from a print group 11, 12 that prints light (yellow) to a print group 11, 12 that prints dark; for example, the recording medium 20 is thus printed to from light to dark in the color order Y-C-M-K.

The recording medium 20 can be produced from paper, metal, plastic or other suitable and printable materials.

Although preferred exemplary embodiments are shown and described in detail in the drawings and in the preceding specification, they should be viewed as purely exemplary and not as limiting the invention. It is noted that only preferred exemplary embodiments are shown and described, and all variations and modifications that presently or in the future lie within the protective scope of the invention should be protected.

I claim as my invention:

1. A digital printer for printing to a recording medium, comprising:

at least one print group with a station to generate charge images of images to be printed on a charge image carrier, said station having a developer station to ink the charge images on the charge image carrier using liquid developer having toner and carrier fluid; and the developer station comprising a rotating application unit that transports the liquid developer to the charge image carrier, a feed system arranged adjacent to the application unit to feed the liquid developer to the application unit, and a dosing unit arranged adjacent to the application unit and after the feed system as viewed in a rotation direction of the application unit, the dosing unit comprising a dosing roller and an elastic unit acting on the dosing roller, the elastic unit exerting an adjustable contact pressure force during printing operation when said charge images are being generated on said charge image carrier on the dosing roller in a direction of the application unit so that the dosing roller is adapted in stages to different application cases during the printing operation.

2. The digital printer according to claim 1 wherein the dosing unit has the dosing roller borne so as to be rotatable on a lever arm that is borne such that it is itself rotatable and has the elastic unit engaging at the lever arm, and wherein the elastic unit comprises at least one spring that exerts the adjustable contact pressure force on the lever arm and the dosing roller in the direction of the application unit.

3. The digital printer according to claim 2 wherein the spring is borne on an eccentric roller at an end facing away from the lever arm such that the contact pressure force of the spring is adjustable via rotation of the eccentric roller.

4. The digital printer according to claim 3 wherein the elastic unit has at least one adjustment mechanism engaging at the lever arm that provides an actuation that acts with a controllable force on the lever arm.

5. The digital printer according to claim 2 wherein the elastic unit has two springs of different elastic force that are respectively borne on an eccentric roller.

6. The digital printer according to claim 5 wherein one of the springs exerts a tensile force on the lever arm.

7. A digital printer of claim 1 wherein the different application cases during the printing operation comprises maintaining a conveyed amount of liquid developer substantially constant when a speed range changes.

8. A digital printer of claim 1 wherein the different application cases comprises adjusting an amount of carrier fluid and toner during the print operation to achieve a same substantially constant print quality.

9. A digital printer for printing to a recording medium, comprising:

at least one print group with a station to generate charge images of images to be printed on a charge image carrier during a printing operation, said station having a developer station to ink the charge images on the charge image carrier using liquid developer having toner and carrier fluid; and the developer station comprising a rotating application unit that transports the liquid developer to the charge image carrier, a feed system arranged adjacent to the application unit to feed the liquid developer to the application unit, and a dosing unit arranged adjacent to the application unit and after the feed system as viewed in a rotation direction of the application unit, the dosing unit comprising a dosing roller and an elastic unit acting on the dosing roller, the elastic unit exerting a continuously adjustable contact pressure force on the dosing roller during said printing operation when said charge images are being generated on said charge image carrier so that the dosing roller is adapted in stages to different application cases.

* * * * *